US011549168B2

(12) United States Patent
Fontaine et al.

(10) Patent No.: US 11,549,168 B2
(45) Date of Patent: Jan. 10, 2023

(54) APPARATUS FOR TREATING A METAL STRIP INCLUDING AN ELECTROMAGNETIC STABILIZER UTILIZING POT MAGNETS

(71) Applicant: Fontaine Engineering und Maschinen GmbH, Langenfeld (DE)

(72) Inventors: Pascal Fontaine, Langenfeld (DE); Dominique Fontaine, Langenfeld (DE); Thomas Daube, Duisburg (DE); Michael Zielenbach, Siegen (DE)

(73) Assignee: Fontaine Engineering und Maschinen GmbH, Langenfeld (DE)

( * ) Notice: Subject to any disclaimer, the term of this patent is extended or adjusted under 35 U.S.C. 154(b) by 157 days.

(21) Appl. No.: 16/610,565

(22) PCT Filed: Apr. 11, 2018

(86) PCT No.: PCT/EP2018/059227
§ 371 (c)(1),
(2) Date: Nov. 4, 2019

(87) PCT Pub. No.: WO2018/202389
PCT Pub. Date: Nov. 8, 2018

(65) Prior Publication Data

US 2021/0189540 A1 Jun. 24, 2021

(30) Foreign Application Priority Data

May 4, 2017 (DE) ..... 10 2017 109 559.4

(51) Int. Cl.
*C23C 2/20* (2006.01)
*C23C 2/00* (2006.01)
(Continued)

(52) U.S. Cl.
CPC ..... *C23C 2/524* (2022.08); *C23C 2/003* (2013.01); *C23C 2/06* (2013.01); *C23C 2/20* (2013.01);
(Continued)

(58) Field of Classification Search
CPC .... C23C 2/04; C23C 2/06; C23C 2/08; C23C 2/10; C23C 2/36; C23C 2/38;
(Continued)

(56) References Cited

U.S. PATENT DOCUMENTS 3,430,174 A * 2/1969 Kazuhiro ..... H01F 37/00 336/83
3,518,109 A 6/1970 Halley
(Continued)

FOREIGN PATENT DOCUMENTS

CA 2794925 A1 5/2011
CN 101151396 A 3/2008
(Continued)

OTHER PUBLICATIONS

Anonymous, PCT Third Party Observation in application PCT/EP2016/068325 of the same applicant, Jul. 6, 2017.
(Continued)

*Primary Examiner* — Karl Kurple
(74) *Attorney, Agent, or Firm* — Smartpat PLC

(57) ABSTRACT

An apparatus for treating a metal strip after it has exited from a coating container with a liquid coating material, for example zinc is provided. The apparatus includes a blow-off device arranged above the coating container having an air outlet gap for blowing off excess parts of the still liquid coating material from the surface of the metal strip after the passing of the metal strip through the coating container. An electromagnetic stabilizer is arranged above the blow-off device and has a plurality of individual magnets for stabi-
(Continued)

lizing the metal strip after leaving the coating container and the blow-off device. In order to further increase the efficiency of the apparatus, at least some of the magnets of the stabilizer are formed as pot magnets with pot coils.

9 Claims, 3 Drawing Sheets

(51) Int. Cl.
*C23C 2/06* (2006.01)
*C23C 2/24* (2006.01)
*C23C 2/26* (2006.01)
*H01F 7/06* (2006.01)

(52) U.S. Cl.
CPC ..... *C23C 2/24* (2013.01); *C23C 2/26* (2013.01); *H01F 7/06* (2013.01)

(58) Field of Classification Search
CPC ..... C23C 2/385; C23C 2/40; C23C 2/405; C23C 2/12; C23C 2/14; C23C 2/20; C23C 2/32; B22F 3/225
See application file for complete search history.

(56) References Cited

U.S. PATENT DOCUMENTS 3,635,748 A 1/1972 Peoples
3,661,116 A 5/1972 Moskowitz et al.
3,778,122 A 12/1973 Doll et al.
4,135,006 A 1/1979 Readal et al.
4,444,814 A 4/1984 Flinchum et al.
4,517,540 A * 5/1985 McDougal ..... F16L 37/084 336/107
4,612,215 A 9/1986 Hennechart et al.
4,994,738 A * 2/1991 Soyck ..... H03K 17/9505 324/207.13
5,384,166 A 1/1995 Sato et al.
5,965,210 A 10/1999 Tada et al.
6,194,022 B1 2/2001 Schunk
8,062,711 B2 * 11/2011 Lofgren ..... C23C 2/40 118/400
8,474,382 B2 7/2013 Bourgier et al.
8,752,502 B2 * 6/2014 Eriksson ..... B05C 11/06 118/62
10,190,203 B2 1/2019 Fontaine et al.
10,650,951 B2 * 5/2020 Sakai ..... H01F 27/2823
2003/0077397 A1 4/2003 Kabeya et al.
2004/0050323 A1 3/2004 Chae
2007/0220940 A1 9/2007 Patzelt et al.
2008/0044584 A1 * 2/2008 Eriksson ..... C23C 2/003 427/430.1
2009/0175708 A1 * 7/2009 Lofgren ..... C23C 2/40 414/222.02
2009/0191360 A1 7/2009 Teramoto et al.
2009/0280270 A1 11/2009 Behrens et al.
2010/0209591 A1 8/2010 Eriksson et al.
2010/0285239 A1 11/2010 Behrens et al.
2011/0177258 A1 7/2011 Ernst et al.
2012/0159901 A1 * 6/2012 Capriotti ..... B29C 66/24244 53/285
2013/0010397 A1 * 1/2013 Ohara ..... C23C 2/20 361/143
2013/0232811 A1 9/2013 Koga et al.
2013/0319326 A1 * 12/2013 Guastini ..... B65G 43/00 118/620
2013/0327806 A1 12/2013 Jang et al.
2014/0027216 A1 * 1/2014 Ohara ..... F16F 15/03 361/139
2014/0144967 A1 * 5/2014 Jang ..... C23C 2/40 226/102
2014/0211361 A1 7/2014 Kurisu et al.
2017/0009326 A1 * 1/2017 Yonekura ..... C23C 2/003
2017/0088381 A1 3/2017 Kurisu et al.
2017/0283929 A1 10/2017 Fontaine
2018/0151284 A1 * 5/2018 Sakai ..... H01F 3/10
2018/0155814 A1 6/2018 Fontaine et al.
2018/0363116 A1 12/2018 Fontaine
2019/0194791 A1 6/2019 Behrens et al.
2019/0390315 A1 * 12/2019 Yonekura ..... B05C 11/1021
2020/0047234 A1 * 2/2020 Yonekura ..... B21D 1/00
2020/0346264 A1 * 11/2020 Yonekura ..... C23C 2/14
2022/0049339 A1 * 2/2022 Behrens ..... C23C 2/36

FOREIGN PATENT DOCUMENTS

CN 101784689 A 7/2010
CN 102597295 A 7/2012
CN 202401120 U 8/2012
CN 205046185 U 2/2016
CN 110352262 A * 10/2019 ..... B05B 12/084
DE 2137850 A1 2/1973
DE 102008039244 A1 3/2009
DE 102007045202 A1 4/2009
DE 102009051932 A1 5/2011
DE 202015104823 U1 10/2015
DE 102015216721 11/2016
JP H0530148 U 4/1993
JP H08199323 A 8/1996
JP H10298727 A 11/1998
JP 2002285309 A 10/2002
JP 3706473 B2 10/2005
KR 19990044375 A 6/1999
KR 20100030664 A 3/2010
KR 20100074979 A 7/2010
KR 20120063550 A 6/2012
RU 2482213 C2 5/2013
RU 2557044 C2 7/2015
WO 0111101 A1 2/2001
WO 2006021437 A1 3/2006
WO 2009039949 A1 4/2009
WO 2012172648 A1 12/2012
WO 2013168668 A1 11/2013
WO 2016078803 A1 5/2016

OTHER PUBLICATIONS

Peter Lofgren et. al, Electromagnetic Strip Stabilizer for Hot Dip Galvanizing Lines, Presented at the Galvanizers Association 97th Meeting Lexington, KY, Oct. 16-19, 2005.
Red Magnetics, "Pot Magnets", unknown publication date, retrieved online at https://www.red-magnetics.com/en/product-groups/others/pot-magnets/ on Nov. 4, 2019.
Rudolf Tremba, Elektromagnete—Topfmagnete, published online at http://www.magnetbasics.de/elektromagnete/topfmagnet.htm, Jul. 24, 2008, retrieved Oct. 30, 2019.
Behrens et al., copending U.S. Appl. No. 17/514,049, 2022.
Korean Intellectual Property Office, Decision for Patent Grant in related application KR 10-2019-7035517, dated Aug. 9, 2021.

* cited by examiner

APPARATUS FOR TREATING A METAL STRIP INCLUDING AN ELECTROMAGNETIC STABILIZER UTILIZING POT MAGNETS

TECHNICAL FIELD

The disclosure relates to an apparatus for treating a metal strip after it has exited from a coating container with a liquid coating material, for example zinc.

BACKGROUND

Such apparatuses are generally known in the prior art, for example from the international patent application WO 2012/172648 A1 and the German patent applications DE 10 2009 051 932 A1, DE 10 2007 045 202 A1 and DE 10 2008 039 244 A1, and from the conference contribution entitled "Electromagnetic strip Stabilizer for Hot Dip Galvanizing Lines," Peter Lofgren et al., held/disclosed at the 97th meeting of the Galvanizers Association, Lexington, Ky., Oct. 16-19, 2005. Specifically, these publications disclose a coating container filled with a liquid coating material. For coating, the metal strip is passed through the container with the coating material. After leaving the coating container, the metal strip passes through a blow-off device or nozzle arranged above the coating container for blowing off excess parts of the still liquid coating material, which adheres to the surface of the metal strip. An electromagnetic stabilizer supported by the blow-off device, also known as a Dynamic Electro-Magnetic Coating Optimizer (DEMCO), is arranged above the blow-off device, to stabilize the strip after leaving the coating container and the blow-off device. The electromagnetic stabilizer generates electromagnetic forces, by which the metal strip is held centrally in a central plane of the entire apparatus; thus, an oscillation of the metal strip during passing through, in particular, the blow-off device is at least reduced.

In practice, however, the disadvantage of these described structures is that the electromagnetic stabilizer is located quite far above the blow-off device. This is disadvantageous in that the stabilizing effect exerted by the stabilizer on the metal strip is only of limited effect on the blow-off device. In addition, the forces to be generated by the stabilizer, which are necessary to stabilize the metal strip in the area of the remote blow-off device, are relatively high in the prior art. Accordingly, the energy required to operate the stabilizer is relatively high. Finally, it is a disadvantage that the stabilizer is located above the nozzle carrier or the traverse, because this makes access to the metal strip in the area of the nozzle carrier considerably more difficult.

This can be remedied by the teaching in accordance with German industrial property rights DE 10 2015 216 721 B3 and DE 20 2015 104 823 U1, which stipulate that the electromagnetic stabilizer must in each case be positioned between the traverse and the blow-off device, and thus even closer to the blow-off device.

It is known from DE 21 37 850 C3 that pot magnets are used for the axially stabilized bearing of a rotating shaft.

SUMMARY

The invention is based on the object of further developing a well-known apparatus for treating a metal strip in order to further increase the efficiency of the machine.

This object is achieved by the subject matter as claimed. In the case of the apparatus described in the introduction, this is achieved by the fact that at least some of the magnets of the stabilizer are formed as pot magnets with pot coils.

Pot magnets have the advantage that they are much more compact than conventional magnets with horseshoe-shaped iron cores. That is, their external dimensions are significantly smaller than those of other magnets with iron cores when designed to generate a magnetic force of the same magnitude. This in turn offers the advantage that the vertical distance between the stabilizer and the blow-off device can be further reduced, thus further increasing the efficiency of the machine. Nevertheless, the magnet coils have little or no influence on the stripping behavior or the air flow of the blow-off device.

According to a first example, for this purpose, it is advantageous if all magnets of the stabilizer are formed as pot magnets.

According to another exemplary embodiment, a horizontal traverse, also known as a nozzle carrier, is mounted between two vertical uprights. The blow-off device is attached to the traverse, preferably suspended from it below the traverse. The stabilizer is also preferably attached in a manner suspended from the traverse below it, but between the traverse and the blow-off device. The mounting of the stabilizer on the traverse is independent of the attachment of the blow-off device on the traverse.

The arrangement of both the stabilizer and the blow-off device underneath the traverse offers the advantage that the area above the traverse, and thus also a slot spanned by the traverse for the passing through of the metal strip, is very easily accessible for an operator.

By using the pot magnets, a closer arrangement of the stabilizer on the blow-off device is possible at a distance of 100-800 mm, preferably in a distance range of 100-550 mm or further preferably in a distance range of 100-450 mm. Due to the small distance, less force must be generated by the stabilizer to stabilize the metal strip in the area of the blow-off device or nozzle. This also reduces the energy requirement of the stabilizer and makes the apparatus more efficient as a whole.

According to another exemplary embodiment, each magnet is preferably assigned with its own distance sensor for the preferably continuous detection of the distance of the respective magnet from the metal strip. Advantageously, this distance sensor is located in the middle of the coreless hollow pot coil. This offers the advantage that the distance sensors do not take up any additional space next to the magnets within the electromagnetic stabilizer, which in turn makes the stabilizer much more compact as a whole. In addition, the distance sensor in the eye of the pot coil is thermally and mechanically protected. The thermal protection exists because the distance sensor is not exposed to direct heat radiation from the zinc pot. The distance sensor can be formed as an eddy current sensor or as an optical sensor.

The apparatus further comprises a regulating device for regulating the position of the metal strip in the slot of the electromagnetic stabilizer to a predetermined target center position, also known as the fitting line. The regulation takes place according to the distances between the magnets and the metal strip determined by the distance sensors, through the suitable variation of the current through the coils of the magnets. In this respect, the distance sensors in conjunction with the regulating device contribute to the fact that the metal strip can be held in the target center position in the slot of the electromagnetic stabilizer, which in turn contributes advantageously to a more uniform coating thickness on the metal strip.

The individual attachment of the blow-off device and the stabilizer on the traverse is effected via independent displacement devices. In concrete terms, the blow-off device is attached to the traverse via a blow-off displacement device, but can be displaced relative to the traverse. Furthermore, the stabilizer is attached to the traverse via a stabilizer displacement device, but can be displaced relative to the traverse. Not only is the stabilizer as a whole displaceable relative to the traverse, but rather each individual magnet of the electromagnetic stabilizer is assigned with an individual displacement device. This makes it possible for each individual magnet to be attached to the traverse and mounted so that it can be displaced relative to the traverse. Each of the displacement devices enables different degrees of freedom for the movement of the blow-off device and the stabilizer in relation to the central plane of the apparatus and also in relation to the metal strip. The displacements enable in particular the displacement of the blow-off device and the stabilizer relative to each other. In particular, the displacement devices enable the blow-off device, the stabilizer as a whole or, optionally, the individual magnets of the stabilizer to be displaced relative to each other. Furthermore, in particular, each of the displacement devices enables the individual displacement of the individual magnets relative to each other in the width direction of the metal strip; that is, in the longitudinal direction of the traverse.

In addition to the individual degrees of freedom for the respective devices realized by the blow-off displacement device and the stabilizer displacement device, it is advantageous that the traverse, together with the blow-off device and stabilizer attached to it, is mounted in a manner vertically displaceable on the vertical uprights. The vertical uprights together with the traverse can be displaced parallel to each other in the horizontal plane. Since the traverse is mounted on one of the vertical uprights so that it can swivel around a fixed pivot point (fixed side) in the horizontal plane and the traverse is mounted loosely on the other vertical upright (loose side), the swiveling of the traverse in the horizontal plane is also possible. These degrees of freedom of the traverse apply equally to the blow-off device and the stabilizer, because both devices are mounted on the traverse.

With the individual magnets, only tensile forces can be exerted on the strip to pull the metal strip in the direction of the magnets. In order to keep the metal strip in the target center position, it is therefore necessary that the magnets of the stabilizer are arranged on both sides of the metal strip. The tensile forces exerted on the strip by the magnets can then be individually adjusted so that they partly compensate each other or hold the strip in the center position. The possibility of shifting the individual magnets, in particular parallel to the plane of the metal strip, given by the stabilizer displacement device, offers the possibility that compensation can also be provided for the unevenness in the metal strip. A separate control device is provided for this purpose, which device moves the magnets parallel to the plane of the metal strip but possibly also offset to each other on both sides of the metal strip in such a manner that the tensile forces generated by the offset magnets generate bending moments in the metal strip that are formed in such a manner that compensation is provided for wave troughs and wave crests in the metal strip as far as possible. This makes the metal strip flat.

Advantageously, in particular in the case of a coating on both sides of the metal strip, the blow-off device has an air gap on both sides of the metal strip.

Finally, the apparatus may include a collision protection device for retracting the electromagnetic stabilizer, in particular the individual magnets, preferably together with their housings, and preferably also for retracting the blow-off device in the event of a malfunction. The stabilizer and/or the blow-off device is then retracted away from the metal strip, in particular in a direction transverse to the plane of the metal strip, such that the metal strip does not collide with the magnets or sensors. A malfunction is, for example, a strip rupture or the detection that a wrong strip is being coated.

DETAILED DESCRIPTION

The invention is described in detail below in the form of exemplary embodiments with reference to the figures mentioned. In all figures, the same technical elements are designated with the same reference signs.

Figure 1:
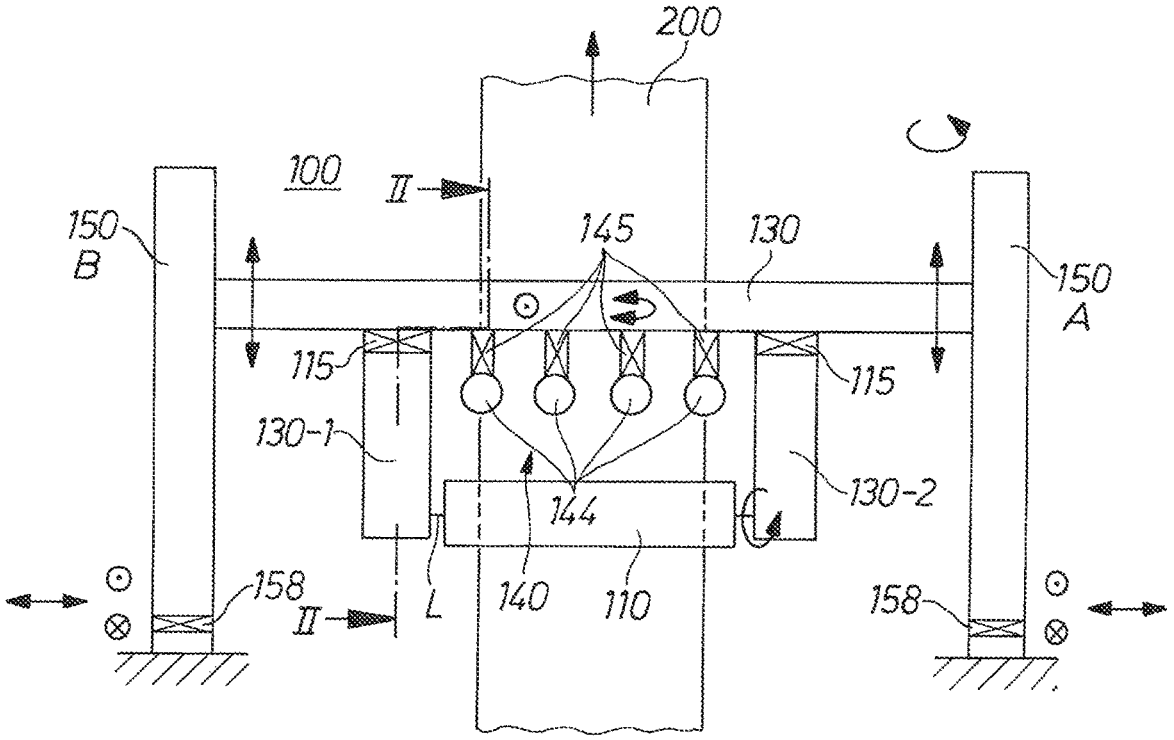
FIG. 1 is a plan view of an apparatus for treating a metal strip.

FIG. 1 shows an apparatus 100 for treating a metal strip. It comprises two vertically extending uprights 150 arranged at the sides, on which a traverse 130, also called a nozzle carrier, is mounted so that it can be displaced vertically; see the double arrows in FIG. 1. The apparatus 100 can also be swiveled in the horizontal plane. For this purpose, one of the two uprights 150 is formed as fixed side A, on which the traverse is mounted so that it can swivel around a vertical axis of rotation. The opposite upright, on the other hand, is formed as loose side B and only supports the traverse vertically. Due to this design of the uprights as fixed and loose sides, the apparatus 100 and in particular the traverse 130 can be aligned symmetrically to the metal strip 200 by swiveling it horizontally with the aid of an upright displacement device 158 when the metal strip 200 is at an angle. As a result, the wide sides of the traverse are always to be aligned parallel to the metal strip and both are to have the same distance from it.

A blow-off device 110 or nozzle is suspended from the traverse 130. The coupling of the blow-off device 110 to the traverse 130 does not take place rigidly, but via a blow-off displacement device 115, which is formed to displace the blow-off device 110 relative to the traverse 130 in the horizontal plane; that is, in particular perpendicular to the center plane 160 of the apparatus. In addition, the blow-off displacement device 115 is formed to swivel the blow-off device 110 around its own longitudinal axis L and thus suitably set against the metal strip 200.

Between the traverse 130 and the blow-off device 110, a stabilizer 140, also called Dynamic Electro-Magnetic Coating Optimizer (DEMCO), is attached to the traverse. The stabilizer 140 comprises a plurality of individual magnets 144 on each side of the metal strip. Preferably, all such magnets are formed as pot magnets. Preferably, each of such magnets is fastened individually to the traverse by a stabilizer displacement device 145. Such stabilizer displacement devices 145 enable the individual, translational displacement of each individual magnet in the horizontal plane relative to the traverse; that is, perpendicular and parallel to the center plane 160 of the apparatus 100, in particular in the longitudinal direction of the traverse. In addition, the stabilizer displacement device 145 can also be formed to swivel the stabilizer 140 in the horizontal plane relative to the traverse 130 and relative to the blow-off device 110 around a vertical axis of rotation.

The use of the pot magnets is not limited to the arrangement between the traverse and the blow-off device. Rather, the pot magnets can also be arranged above the traverse.

Figure 2:
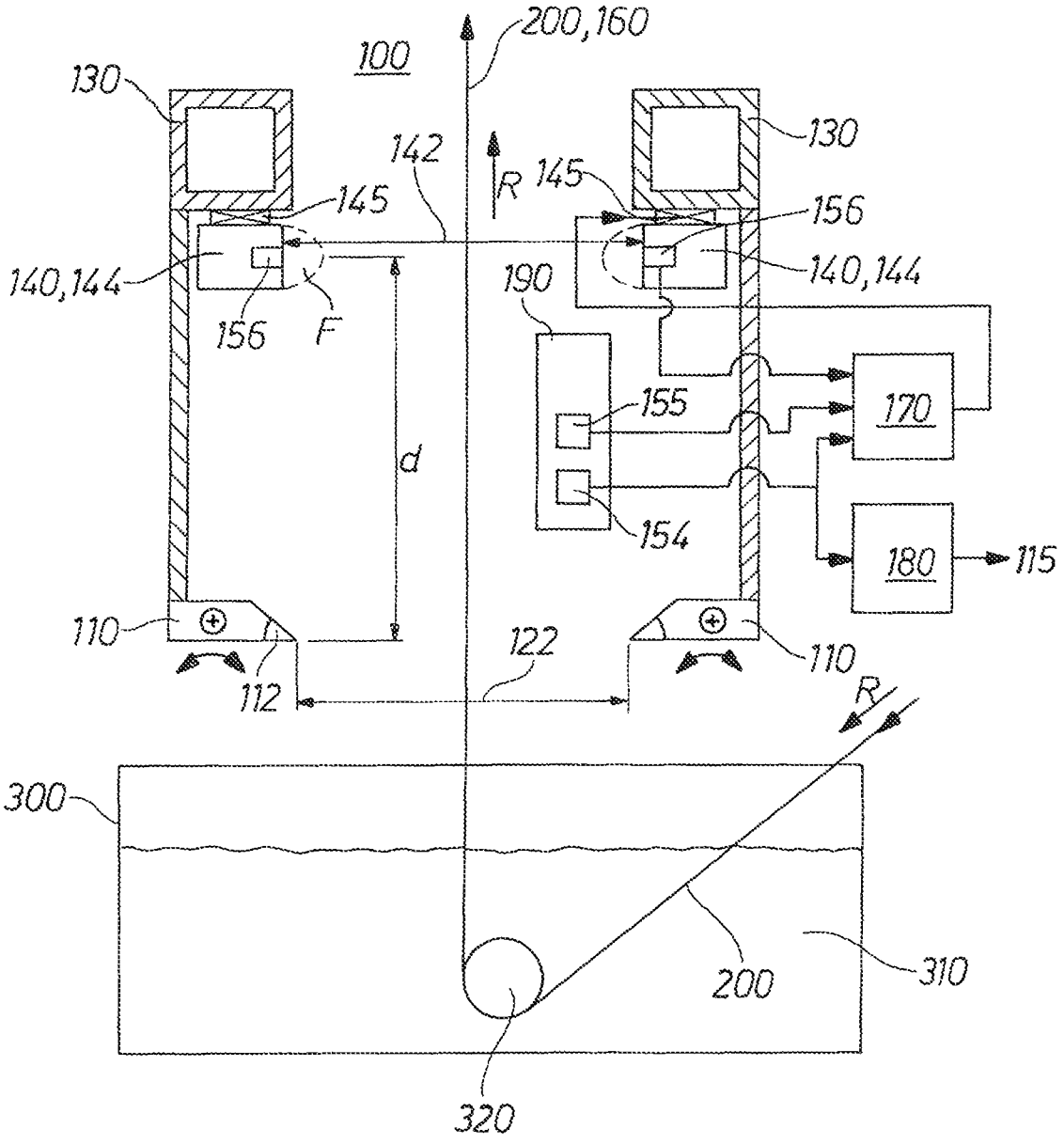
FIG. 2 shows a cross-section of the apparatus as in FIG. 1.

FIG. 2 shows the apparatus from FIG. 1 in a cross-sectional view. The reference sign 170 designates a control device for controlling the stabilizer displacement devices 145. A coating container 300 can be recognized; in principle, this is located below the apparatus 100. The metal strip 200 to be coated is fed in transport direction R into the coating container 300 with the liquid coating material 310 and deflected into the vertical position by a deflection roller 320. It then passes from bottom to top initially through the blow-off device 110 and then through the stabilizer 140. In an advantageous configuration, the distance d between the line of action of the maximum force F of the stabilizer on the metal strip 200 and the air outlet gap 112 lies in a range from 100 to 800 mm, preferably in a range from 100 to 550 mm or further preferably in a range from 100 to 450 mm.

The blow-off device 110 spans a slot 122, through which the metal strip 200 is guided. The blow-off device is used to blow off excess coating material from the surface of the metal strip 200.

Figure 3:
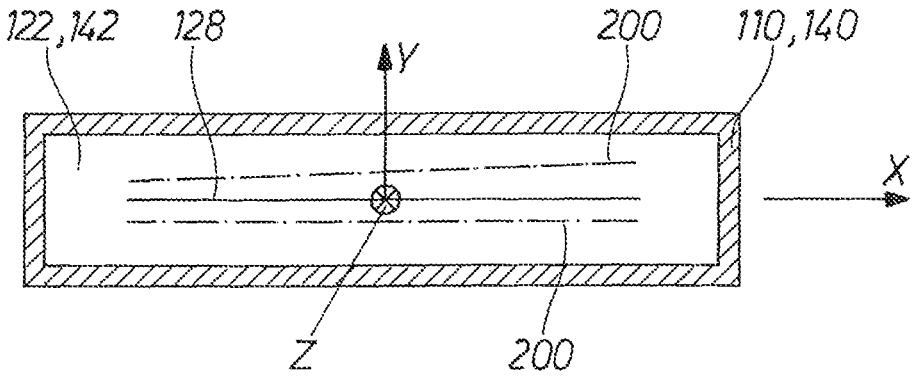
FIG. 3 and FIG. 4 are top views of a slot of a blow-off device and an electromagnetic stabilizer, in each case with a marking of the target center position and various undesirable actual positions of the metal strip.

To ensure that the blow-off on the top and bottom sides of the metal strip 200 is uniform, it is important that the metal strip 200 passes through the slot 122 of the blow-off device 110 in a specified target center position, also known as the center plane 160 or the fitting line reference position, as symbolized in FIG. 3 in the form of the continuous line in the X direction. This target center position is characterized in particular by uniform distances or distance distributions to the inner edges of slot 122 of the blow-off device 110. In addition to the desired target center position 128, FIG. 3 also shows possible undesired actual positions of the metal strip as dashed lines. For example, undesired actual layers for the metal strip 200 consist of the fact that it is twisted in relation to the target center layer or shifted parallel in the Y direction.

Figure 4:
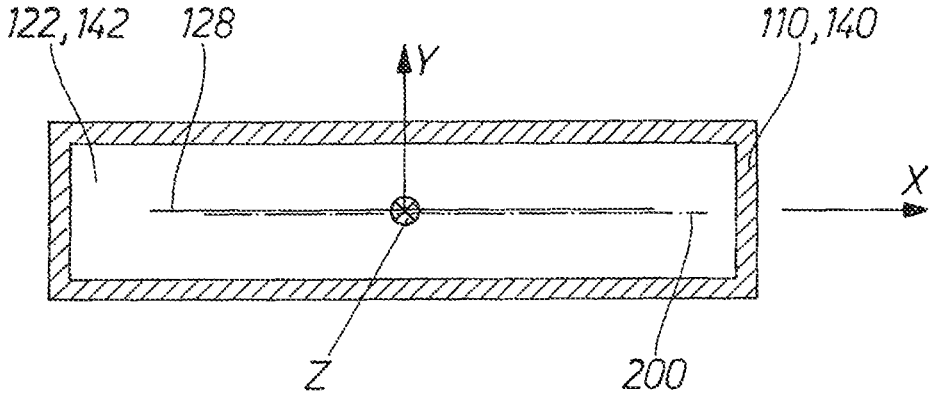

FIG. 4 shows a third possible undesired actual position, in which the metal strip 200 is shifted parallel to the target center position in the X-direction; that is, in the width direction.

On its part, the electromagnetic stabilizer 140 has a slot 142 through which the metal strip 200 is also guided. Here as well, the metal strip 200 passes through the slot 142, preferably in a predetermined target center position 160, as shown in FIGS. 3 and 4. This is achieved by ensuring that the forces provided by the magnets of the 140 electromagnetic stabilizer act in a suitable manner on the metal strip 200. The same applies to slot 142 and the target center position pursued there, as before with reference to FIGS. 3 and 4 for the slot 122 of the blow-off device 110.

A first detection device 154 for detecting a deviation of the actual position of the metal strip 200 from a predetermined target center position in the slot 122 of the blow-off device 110 is further arranged between the stabilizer 140 and the blow-off device 110. Alternatively, the first detection device 154 can be formed to detect only the actual position of the metal strip. A regulating device 180 is also provided to regulate the actual position of the metal strip 200 to the specified target center position 128 in the slot 122 of the blow-off device, as explained above with reference to FIGS. 3 and 4. This regulation can be effected a) by displacing the blow-off device 110 with the aid of a blow-off displacement device 115 and/or b) by displacing the traverse 130, on which the blow-off device 110 is suspended, with the aid of an upright displacement device 158. The regulation takes place in response to the detected deviation from the actual position to the target position. If the deviation of the actual position from the target center position is not determined in the first detection device 154, it can also be determined, for example, within the regulating device 180. The blow-off device 110 is displaced in a horizontal plane transverse to the transport direction R of the metal strip in accordance with the detected deviation of the actual position of the metal strip from the specified target center position in the slot 122 of the blow-off device. In other words: If it is determined that the metal strip 200 does not pass through the slot 122 in the target center position 128, the blow-off device 110 is displaced by the blow-off displacement device 115 in such a manner that the metal strip passes through the slot 122 of the blow-off device once again into the target center position 128. For this purpose, the first detection device 154 is formed in such a manner that it can preferably detect all three actual positions of the metal strip 200 deviating from the target center position 128 as described above with reference to FIGS. 3 and 4.

The specified displacement of the blow-off device 110 is not to affect the electromagnetic stabilizer 140. For this purpose, the control device 170 is formed to control the stabilization displacement device 145 of the individual magnets 144 in such a manner that, in the event of a displacement of the blow-off device 110 with respect to a fitting line reference position, the electromagnetic stabilizer 140 is not moved with it, but can remain at its original position. The stabilizer 140 and the blow-off device 110 are decoupled from each other. That is, they can be moved independently from each other and relative to each other by their respective displacement devices 145, 115. The fitting line reference position 160 designates a fixed defined center plane of the apparatus. In contrast, the target center positions 128 refer to slots 122, 142. The control device 170 therefore acts on the stabilizing displacement devices 145 in such a manner that, in the event of the displacement of the blow-off device 110, the electrical stabilizers 140 preferably makes the exact opposite movement to that of the blow-off device 110; that is, as a result, it preferably remains in its original position.

In order to realize this special type of control for the stabilizer displacement devices 145, the control device 170 is able to evaluate different situations. On the one hand, the control device 170 can be formed to carry out the displacement of the electromagnetic stabilizer 140 or the individual magnets 144 in accordance with the deviation of the actual position of the metal strip from the predetermined target center position of the metal strip in the slot 122 of the blow-off device 110 detected by the first detection device 154.

Alternatively or in addition, the control device 170 can be formed to carry out the displacement of the electromagnetic stabilizer 140 or the individual magnets 144 as required and in the opposite direction to the displacement of the blow-off device 110 detected by a second detection device 155. The second detection device 155 serves to detect the displacement of the blow-off device 110 in relation to a fitting line reference position 160 of the apparatus 100.

Finally, according to an additional alternative or as a supplement, the control device 170 can be formed to cause the displacement of the electromagnetic stabilizer 140 and the individual magnets 144, respectively, in accordance with a detected deviation of the actual position of the metal strip from a predetermined target center position in the slot 142 of the electromagnetic stabilizer. A prerequisite for this is that a third detection device 156 is provided for detecting the specified deviation of the actual position of the metal strip from the predetermined target center position in the slot 142 of the electromagnetic stabilizer 140. Preferably, each magnet 144 is assigned with such a third detection device 156 as a distance sensor. Preferably, such sensors are arranged in the pot magnets. For example, they work optically or with the aid of induced eddy currents.

Each of the first, second and third detection devices 154, 155, 156 is formed to detect preferably all conceivable deviations of an actual position of the metal strip from the desired target center position. These include in particular a (parallel) displacement of the metal strip in the x or y direction or a twist, as explained above with reference to FIGS. 3 and 4. Accordingly, the stabilizing and blow-off displacement devices 145, 115—with suitable actuation by the regulating device 180 or the control device 170—are formed to move the blow-off device 110 and the electromagnetic stabilizer 140 in the horizontal plane transversely to the transport direction R of the metal strip in any manner, in particular to displace them (in a parallel direction) or to rotate them around a vertical axis of rotation, in order to realize the passing through of the metal strip into the target center position.

The first and third detection devices 154, 156 and optionally also the second detection device 155 can be realized in the form of one or more optical sensor devices 190. In this respect, the sensor device forms a structural unit for the specified detection devices. Preferably, one sensor device 190 per coil is provided in the electromagnetic stabilizer 140. The measured values of all sensor devices are typically averaged. The sensor device 190 can also be generally referred to as a distance detection device.

If a deviation of the actual position from the target position of the metal strip is detected within the electromagnetic stabilizer 140, in particular with the aid of the third detection device 156, the actual position to the target position or on the fitting line is regulated with the aid of the control 170 through suitable individual variation of the currents through the coils in the magnets 144.

LIST OF REFERENCE SIGNS

100 Apparatus
110 Blow-off device
112 Air outlet gap
115 Blow-off displacement device
122 Slot of the blow-off device
128 Target center level
130 Traverse
140 Stabilizer
142 Slot of the stabilizer
144 Magnet
145 Stabilizer displacement device
150 Side upright
154 First detection device
155 Second detection device
156 Third detection device (=distance sensor)
158 Upright displacement device
160 Fitting line reference position of the apparatus
170 Control device
180 Regulating device
190 Sensor device
200 Metal strip
300 Coating container
310 Coating material
A Fixed side
B Loose side
d Distance
F Force
L Longitudinal axis blow-off device
R Transport direction of the metal strip
X Width direction of the metal strip in the target center position
Y Direction transverse to the plane spanned by the metal strip

What is claimed is:

1. An apparatus for treating a metal strip after the metal strip has exited from a coating container of a liquid coating material, comprising:

a blow-off device arranged above the coating container, the blow-off device having an air outlet gap for blowing off an excess liquid coating material from a surface of the metal strip after the metal strip has passed through the coating container; and an electromagnetic stabilizer arranged above the blow-off device comprising a first plurality of magnets and a second plurality of magnets for stabilizing the metal strip after leaving the coating container and the blow-off device, wherein the first plurality of magnets and the second plurality of magnets are arranged on opposite sides of the metal strip, wherein the first plurality of magnets and the second plurality of magnets are individually fastened to a traverse by a plurality of stabilizer displacement devices, and each magnet of the first plurality of magnets and each magnet of the second plurality of magnets being individually fastened to the traverse by a corresponding one of the plurality of stabilizer displacement devices, wherein the plurality of stabilizer displacement devices enables individual, translational displacement of each magnet of the first plurality of magnets and the second plurality of magnets in a horizontal plane relative to the traverse, and wherein each magnet of the first plurality of magnets is configured to be displaced relative to each magnet of the second plurality of magnets;

wherein the first plurality of magnets includes a first pot magnet with a first pot coil therein, wherein the second plurality of magnets includes a second pot magnet with a second pot coil therein, wherein the first pot magnet includes a first distance sensor arranged in a middle of the first pot coil, and wherein the second pot magnet includes a second distance sensor arranged in a middle of the second pot coil.

2. The apparatus according to claim 1, wherein all of the magnets of the electromagnetic stabilizer are pot magnets with pot coils therein.

3. The apparatus according to claim 1, further comprising a horizontal traverse mounted between two vertical side uprights, wherein the blow-off device is suspended from the horizontal traverse, and wherein the electromagnetic stabilizer is arranged between the horizontal traverse and the blow-off device and fastened to and suspended from the horizontal traverse independently of the blow-off device.

4. The apparatus according to claim 1, wherein the electromagnetic stabilizer is arranged above the blow-off device in such a manner that a distance between a line of action of a maximum force of the electromagnetic stabilizer on the metal strip and the air outlet gap is in a range of 100-800 mm.

5. The apparatus according to claim 1, further comprising a regulating device for controlling a position of the metal strip in a slot of the electromagnetic stabilizer to a predetermined target center position in accordance with distances determined by the first distance sensor and the second distance sensor through a variation of a first current through the first pot coil and a variation of a second current through the second pot coil.

6. The apparatus according to claim 1, wherein each stabilizer displacement device is formed to displace a corresponding magnet to which the corresponding one of the plurality of stabilizer displacement devices is individually fastened in a width direction of the metal strip.

7. The apparatus according to claim 1, wherein the blow-off device has the air outlet gap on both sides of the metal strip.

8. The apparatus according to claim 1, wherein the first plurality of magnets includes four magnets that are arranged at a same distance underneath the traverse.

9. The apparatus according to claim 1, wherein each of the first plurality of magnets are configured to move parallel to a plane of the metal strip and assume a position which is offset relative to the second plurality of magnets.

* * * * *